US008851922B2

(12) United States Patent
Miyazaki

(10) Patent No.: US 8,851,922 B2
(45) Date of Patent: Oct. 7, 2014

(54) ELECTRICAL CONNECTOR DEVICE AND CONNECTOR USED IN THE ELECTRICAL CONNECTOR DEVICE

(75) Inventor: Atsuhiro Miyazaki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 49 days.

(21) Appl. No.: 13/565,258

(22) Filed: Aug. 2, 2012

(65) Prior Publication Data

US 2013/0040474 A1 Feb. 14, 2013

(30) Foreign Application Priority Data

Aug. 11, 2011 (JP) ..... 2011-176088

(51) Int. Cl.
*H01R 12/24* (2006.01)
*H01R 13/648* (2006.01)
*H01R 12/71* (2011.01)

(52) U.S. Cl.
CPC ..... *H01R 13/648* (2013.01); *H01R 12/712* (2013.01)
USPC ..... 439/497; 439/660

(58) Field of Classification Search
USPC ..... 439/108, 495–498, 607.09, 607.13, 439/607.35, 607.36, 660
See application file for complete search history.

(56) References Cited

U.S. PATENT DOCUMENTS 7,134,912 B2 * 11/2006 Kamata et al. ..... 439/607.31
7,344,411 B2 * 3/2008 Ker et al. ..... 439/607.36
7,771,232 B2 * 8/2010 Si et al. ..... 439/607.01
7,934,957 B1 * 5/2011 Nakajima et al. ..... 439/607.49
8,021,187 B2 * 9/2011 Tagawa et al. ..... 439/607.31
8,241,069 B2 * 8/2012 Yamaji ..... 439/660
8,388,370 B2 * 3/2013 Yamaji et al. ..... 439/497
8,465,324 B2 * 6/2013 Ikari et al. ..... 439/607.31
8,550,849 B2 * 10/2013 Yamaji ..... 439/607.41

FOREIGN PATENT DOCUMENTS

JP 2006-172824 A 6/2006
JP 2009-134947 A 6/2009
JP 2011-119152 A 6/2011

* cited by examiner

*Primary Examiner* — Thanh Tam Le

(74) *Attorney, Agent, or Firm* — Kubotera & Associates, LLC

(57) ABSTRACT

An electrical connector device includes a first connector including a first metal shell member; and a second connector to be mounted on a board and including a second metal shell member. The second connector includes an opening portion for receiving a fitting portion of the first connector in a fitting direction. The second metal shell member includes a ground connecting portion to be contacted with the board and a ground contacting member situated in a cut hole. The ground contacting member is arrange to be capable of contacting with the first metal shell member. The ground connecting portion is arranged partially on a first imaginary straight line perpendicular to the fitting direction and a second imaginary straight line in parallel to the fitting direction so that the cut hole is not situated on the first imaginary straight line and is situated partially on the second imaginary straight line.

8 Claims, 5 Drawing Sheets

ELECTRICAL CONNECTOR DEVICE AND CONNECTOR USED IN THE ELECTRICAL CONNECTOR DEVICE

BACKGROUND OF THE INVENTION AND RELATED ART STATEMENT

The present invention relates to an electrical connector device and a connector used in the electrical connector device.

Patent Reference has disclosed a conventional electrical connector device formed of two connectors capable of being fitted together. A metal shell member covers an outer circumference of each of the connectors. When a fitting portion of one of the connectors is fitted into the other of the connector, the connectors are connected together physically as well as electrically.

Patent Reference: Japanese Patent Publication No. 2011-119152

In the conventional electrical connector device disclosed in Patent Reference, the other of the connectors includes a ground connecting portion to be mounted on a board, and a ground contacting member disposed inside the other of the connectors for contacting with the fitting portion of one of the connectors. The ground connecting portion is formed to protrude toward the board as a part of the metal shell member. Further, the ground contacting member is formed of a part of the metal shell member cut and bent inside the connector in a cantilever shape.

In the conventional electrical connector device described in Patent Reference, when one of the connectors is inserted into the other of the connectors, the ground contacting member contacts with the metal shell member of one of the connectors.

In the conventional electrical connector device described in Patent Reference, when the ground contacting member is formed, a hole is inevitably formed around the ground contacting member. Further, the ground connecting portion is formed in a region of the hole both arranged on an imaginary straight line extending in parallel to the fitting direction of the connectors.

In the conventional electrical connector device described in Patent Reference, when the ground connecting portion is formed in a region of the hole both arranged on an imaginary straight line extending in parallel to the fitting direction of the connectors, it is necessary to secure a length in the fitting direction at least corresponding to a sum of the region of the hole and the ground connecting portion. Accordingly, it is difficult to reduce a size of the conventional electrical connector device.

In view of the problems described above, an object of the present invention is to provide an electrical connector device formed of two connectors capable of being fitted together, and capable of solving the problems of the conventional electrical connector device. In the electrical connector device of the present invention, one of the connectors includes a ground connecting portion to be mounted on a board, and a ground contacting member disposed inside the connector for contacting with a fitting portion of the other of the connectors. In the electrical connector device of the present invention, it is possible to reduce a size thereof in the fitting direction of the connectors.

Further objects and advantages of the invention will be apparent from the following description of the invention.

SUMMARY OF THE INVENTION

In order to attain the objects described above, according to a first aspect of the present invention, an electrical connector device is formed of a first connector and a second connector to be mounted on a board. When a fitting portion of the first connector is fitted into the second connector, the first connector and the second connector are connected together physically as well as electrically. The first connector includes a first metal shell member covering an outer circumference of the first connector. The second connector includes a second metal shell member covering an outer circumference of the second connector.

According to the first aspect of the present invention, the second metal shell member of the second connector includes a ground connecting portion formed at a portion thereof on a side facing the board and a ground contacting member formed of a part thereof cut toward inside the second connector in a cantilever shape. The ground contacting member is arrange to be capable of contacting with the first metal shell member of the first connector when the fitting portion of the first connector is fitted into the second connector.

According to the first aspect of the present invention, when the ground contacting member is formed, a hole is formed in the second metal shell member around the ground contacting member. The ground connecting portion and a region of the hole are not arranged on an imaginary straight line extending in parallel to the fitting direction. The ground connecting portion and the region of the hole are at least partially arranged on another imaginary straight line extending in parallel to a direction perpendicular to the fitting direction.

According to a second aspect of the present invention, in the electrical connector device in the first aspect, the ground connecting portion may be formed of a part of the second metal shell member being bent toward the board. Alternatively, the ground connecting portion may be formed of a part of the second metal shell member being punched in a protruded shape toward the board. Accordingly, when the ground connecting portion is formed, it is not necessary to provide a separate part, thereby reducing the number of components.

According to a third aspect of the present invention, in the electrical connector device in the first aspect, the ground connecting portion may be arranged at each of a plurality of positions along the direction perpendicular to the fitting direction. Further, the ground contacting member may be arranged at each of a plurality of positions along the direction perpendicular to the fitting direction. Accordingly, it is possible to securely connect the ground connecting portion and the ground contacting member with the first connector and the board.

According to a fourth aspect of the present invention, in the electrical connector device in the first aspect, the ground connecting portion and the ground contacting member may be arranged alternately with a specific distance in between. Accordingly, the ground connecting portion separates between the holes, thereby preventing flux from scattering. Further, when the first connector is connected to the second connector, it is possible to uniformly disperse a force received from the first connector against the second connector in a longitudinal direction of the second connector (the direction perpendicular to the fitting direction).

According to a fifth aspect of the present invention, in the electrical connector device in the first aspect, the ground contacting member may be formed in a cantilever shape along the fitting direction. Accordingly, when the first connector is connected to the second connector, it is possible to make the ground contacting member smoothly contact with the first metal shell member of the first connector. Further, the ground contacting member may be supported on a side of the insertion portion of the first connector, and the ground contacting member preferably includes a free end portion on a side opposite to the insertion portion of the first connector.

According to the present invention, the electrical connector device is formed of the two connectors capable of being fitted together. In the electrical connector device of the present invention, one of the connectors includes the ground connecting portion to be mounted on the board, and the ground contacting member disposed inside the connector for contacting with the fitting portion of the other of the connectors. In the electrical connector device of the present invention, it is possible to reduce a size thereof in the fitting direction of the connectors.

DETAILED DESCRIPTION OF THE PREFERRED EMBODIMENTS

Hereunder, embodiments of the present invention will be explained with reference to the accompanying drawings.

Figure 1:
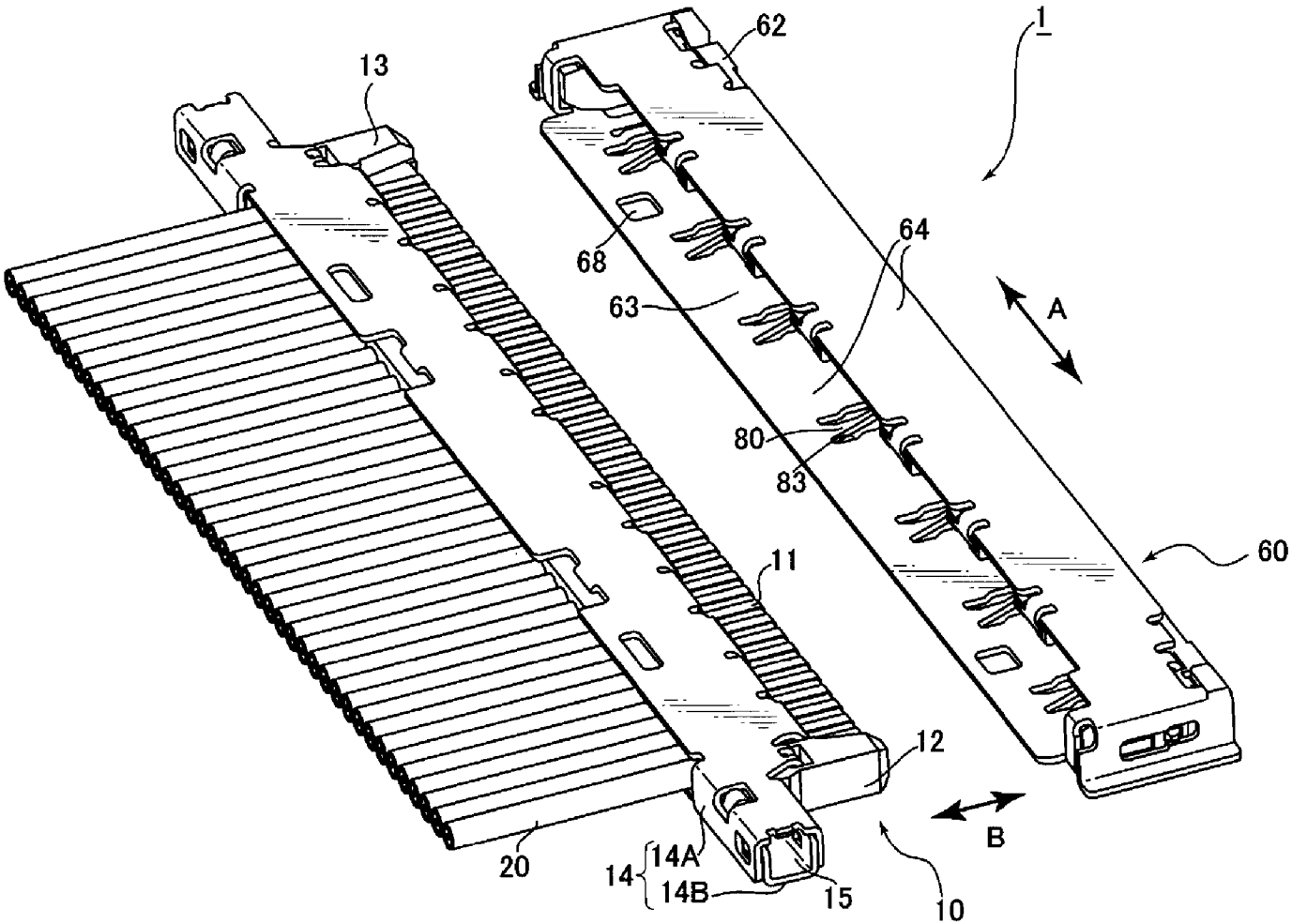
FIG. 1 is a perspective view showing an electrical connector device according to an embodiment of the present invention.

FIG. 1 is a perspective view showing an electrical connector device 1 according to an embodiment of the present invention. The electrical connector device 1 includes a plug connector 10 and a receptacle connector 60 being connected to each other. The plug connector 10 is configured as a connector to which a cable is attached. A plurality of the cables are able to be attached to an end portion of the plug connector 10, which is opposite to an end the receptacle connector 60 is connected.

In the embodiment, the receptacle connector 60 is configured as a connector to be mounted on a board (not shown). The plug connector 10 and the receptacle connector 60 extend in a longitudinal direction A thereof (a contact disposing direction) as shown FIG. 1, in other words, a direction perpendicular to a fitting direction or a connecting direction B in FIG. 1, respectively. Further, the plug connector 10 and the receptacle connector 60 have symmetrical shapes about the connecting direction B, respectively.

In the embodiment, the plug connector 10 mainly includes a contact 11, a housing 12 for holding the contact 11 and a metal shell member or a shell 14 made of a metal. The shell 14 is arranged to cover an outer circumferential surface of the housing 12. Similarly, the receptacle connector 60 mainly includes a contact 70, a housing 62 for holding the contact 70 and a metal shell member or a shell 64 made of a metal. The shell 64 is arranged to cover an outer circumferential surface of the housing 62.

When plug connector 10 and the receptacle connector 60 are connected to each other, a fitting portion 13 of the plug connector 10 is inserted along the connecting direction B toward inside the receptacle connector 60 through a fitting opening 63 of the receptacle connector 60.

When the plug connector 10 and the receptacle connector 60 are connected to each other, a plurality of the contacts 11 provided in the plug connector 10 contacts the contact 70 corresponding to the contact 11 provided in the receptacle connector 60. Thereby, the board and are the cables 20 attached to the plug connector 10 connected to each other electrically. In addition, it is possible to increase a shielding effect as the shell 14 of the plug connector 10 and the shell 64 of the receptacle connector 60 contact each other.

In the embodiment, the shell 14 of the plug connector 10 includes an upper shell 14A for covering an upper side of the housing 12 and a lower shell 14B for covering a lower side of the housing 12. By utilizing the upper shell 14A and the lower shell 14B, a supporting portion 15 for supporting a rotation pull bar (not shown) may be formed in both end portions of the shell 14 in the longitudinal direction A.

Figure 2:
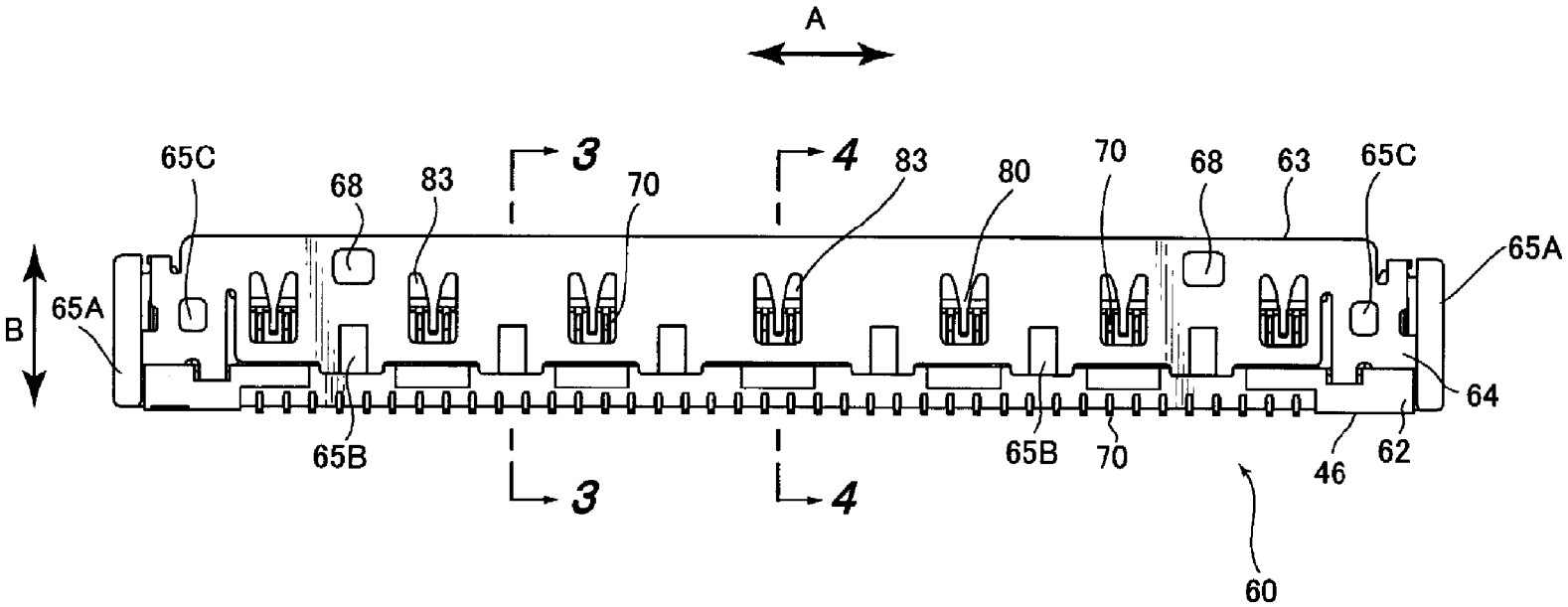
FIG. 2 is a bottom view showing a receptacle connector of the electrical connector device according to the embodiment of the present invention.
Figure 3:
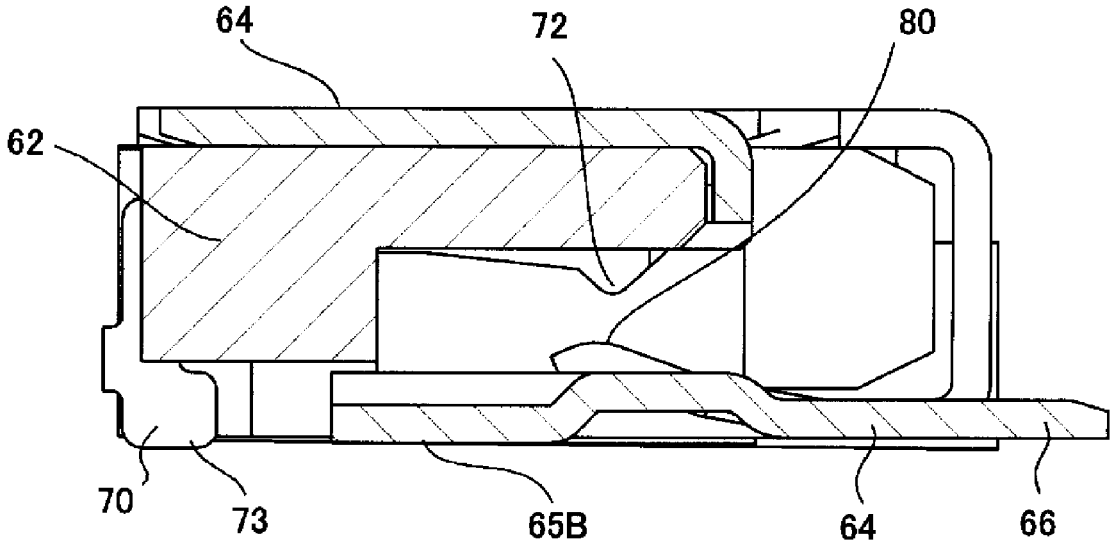
FIG. 3 is a sectional view of the receptacle connector taken along a line 3-3 in FIG. 2 according to the embodiment of the present invention.
Figure 4:
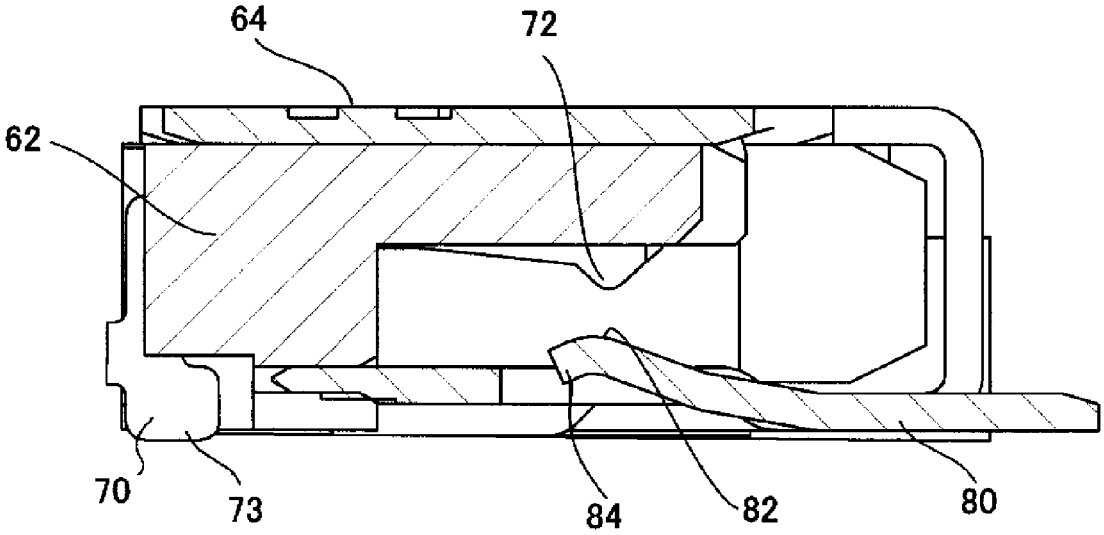
FIG. 4 is a sectional view of the receptacle connector taken along a line 4-4 in FIG. 2 according to the embodiment of the present invention.

In the embodiment, the shell 64 of the receptacle connector 60 may be formed by punching out and then bending a metal plate. In FIG. 2, a bottom view of the receptacle connector 60 is shown. In FIGS. 3 and 4, sectional views of the receptacle connector 60 taken along a line 3-3 and a line 4-4 are shown, respectively.

A soldering portion 65A is provided in each of end portions in the longitudinal direction A of a bottom surface of the shell 64. The soldering portion 65A is formed by bending the end portion of the shell 64. The soldering portion 65A is connected to the board by being soldered when the receptacle connector 60 is mounted on the board. The soldering portion 65A is connected to a ground through the board thus connected.

Further, the shell 64 includes a soldering portion 65C and a ground connecting portion 65B. Furthermore, the shell 64 includes a ground contacting member or a ground contact piece 80 and a locking hole 68. The soldering portion 65C is similar to the soldering portion 65A. The plug connector 10 is easily locked to the receptacle connector 60 as an engaging portion (not shown) of the plug connector 10 engages the locking hole 68.

In the embodiment, the soldering portion 65C is situated on each of the end portions in the longitudinal direction A of the bottom surface of the shell 64, in other words, a surface facing the board. The soldering portion 65C is formed by partially protruding the bottom surface of the shell 64 toward the board. Since the soldering portion 65C protrudes toward the board, the soldering portion 65C contacts easily to the board, being compared to a surrounding surface thereof.

Therefore, the soldering portion 65C is able to be soldered to the board easier. Similar to the soldering portion 65A, the soldering portion 65C is connected by being soldered to the board when the receptacle connector 60 is mounted on the board. The soldering portion 65C is connected to the ground through the board thus connected.

In the embodiment, the ground connecting portion 65B is formed by partially protruding the surface facing the board in a direction of the board, similar to the soldering portion 65C. Further, the ground connecting portion 65B is connected to the board by being soldered when the receptacle connector 60 is mounted on the board. The ground connecting portion 65B is connected to the ground through the board thus connected. As shown in FIG. 3, the ground connecting portion 65B may be formed, e.g., by partially hammer out the shell 64 toward the board into a protruded shape. Alternatively, as shown in FIG. 5, a ground connecting portion 65B' may be formed, e.g., by partially bending a shell 64' toward the board.

Figure 5:
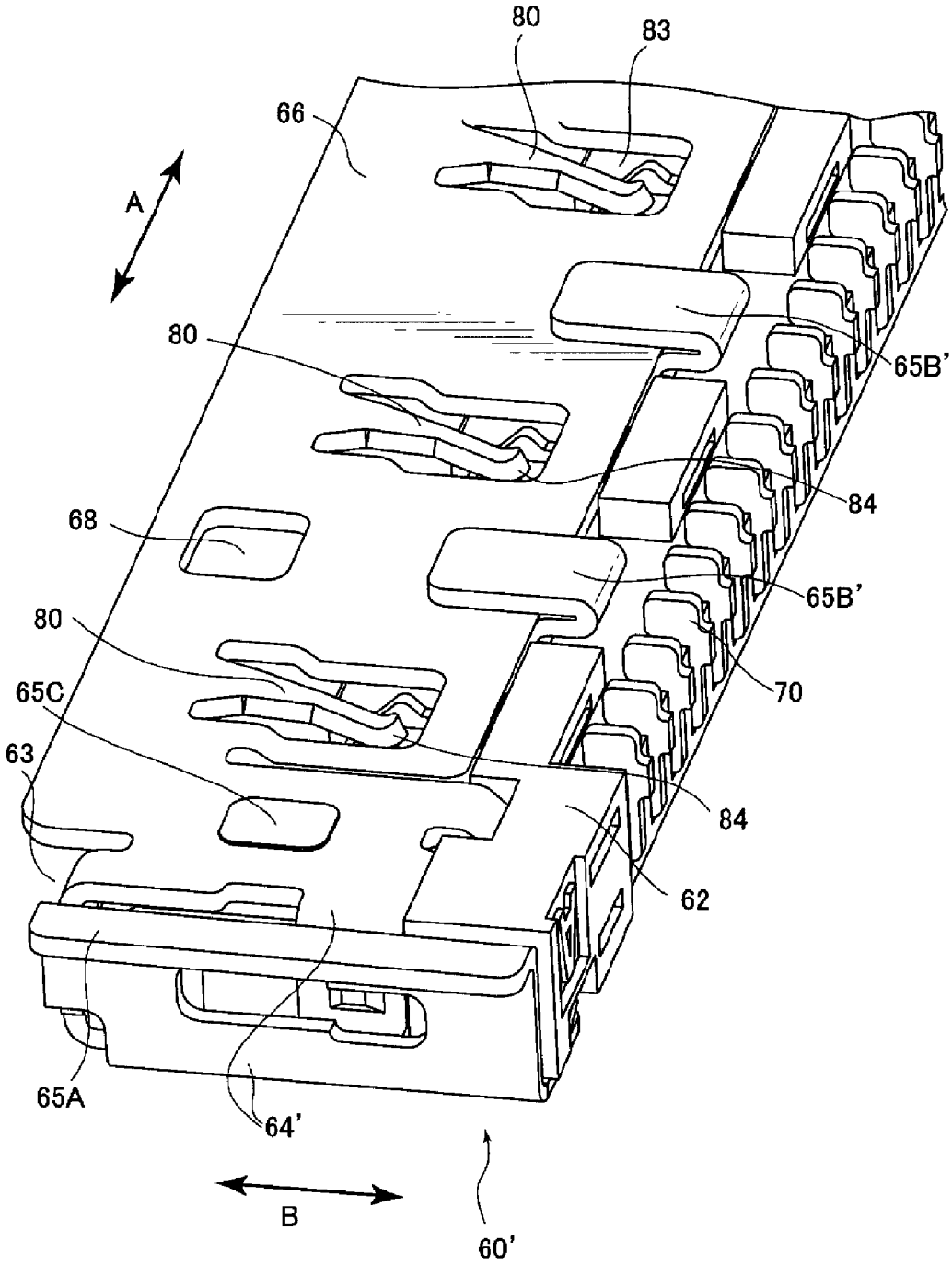
FIG. 5 shows a modified example of a ground connecting portion of the electrical connector device according to the embodiment of the present invention.

FIG. 5 is a perspective view showing a receptacle connector 60' being viewed from a bottom surface thereof, according to a modified example of the present invention. The receptacle connector 60' shown in FIG. 5 basically has the same configuration with the receptacle connector 60 shown in FIGS. 1 to 4. In FIG. 5, components being the same with components in FIGS. 1-4 have the same numerical references.

In the embodiment, the shell 64 is able to partially protrude toward the board by utilizing methods described above. Therefore, the shell 64 is allowed to partially contact the ground easily and steadily when the receptacle connector 60 is mounted on the board. In addition, as described above, when the ground connecting portions 65B and 65B' are formed by hammering out or bending, a hole is not provided around the ground connecting portions 65B and 65B' to which solder is applied. Therefore, even if flux is scattered, the flux does not come into the fitting opening 63.

In the embodiment, the ground connecting piece 80 is formed by partially cutting the surface facing the board of the shell 64. Then the surface thus cut is raised toward inside the receptacle connector 60 so as to form a cantilever shape. The ground connecting piece 80 is capable of elastic displacement in a vertical direction.

When the fitting portion 13 is inserted toward inside the receptacle connector 60, the ground piece 80 is able to contact the ground, that is, able to elastically contact the shell 14, especially with the lower shell 14B of the plug connector 10 around a contact point portion 82 (refer to FIG. 4) thereof. Further, at the same time, the contact 71 contacts the contact 11 of the plug connector 10 with a contact point portion 72 thereof. The contact 70 is soldered to the board at a board connecting portion 73 thereof situated a lower end portion thereof.

As shown in FIG. 2, it is preferred that the ground contact piece 80 provided inside the receptacle connector 60 is formed so as to extend in the connecting direction B. Further, it is preferred that the ground contact piece 80 is provided so as to be supported at an end thereof where the plug connector 10 is inserted while a free end portion 84 is provided at an end thereof opposite to where the plug connector 10 is inserted. Being configured as described above, the ground contact piece 80 is able to be displaced gradually as the fitting portion 13 moves inside the receptacle connector 60, enabling the ground contact piece 80 to contact the lower shell 14B smoothly. As a result, it is possible to prevent the ground contact piece 80 from being damaged.

Figure 6:
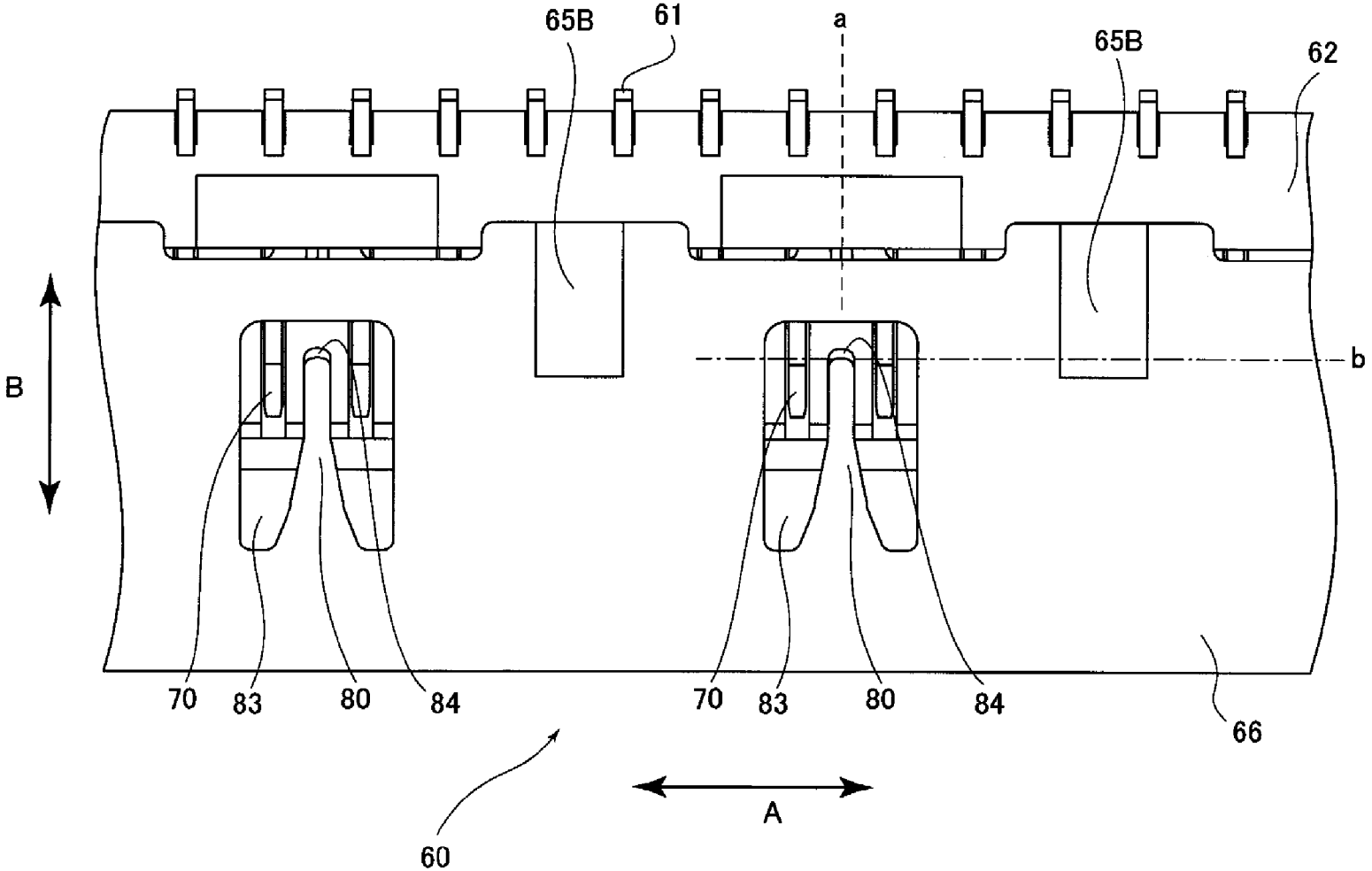
FIG. 6 is a partially enlarged view of the receptacle connector in FIG. 2 according to the embodiment of the present invention.

FIG. 6 shows a partial enlarged view of FIG. 2.

When the ground contact piece 80 is formed by partially cutting and raising the shell 64, a hole 83 with a specific size is necessarily formed around the ground contact piece 80. As shown in FIG. 6, in the present invention, a region of the hole 83 and the ground contact portion 65B are not arranged on the same imaginary line substantially parallel with the connecting direction B (e.g., a dashed line a in FIG. 6). On the other hand, the region of the hole 83 and the ground contact portion 65B are arranged so that at least portions thereof are situated on the same imaginary line, that is, on a line substantially parallel with the longitudinal direction A which is perpendicular to the connecting direction B (e.g., a dashed line b in FIG. 6).

When the ground contact portion 65B and the region of the hole 83 are arranged on the same line substantially parallel with the connecting direction B (e.g., the dashed line a), the receptacle connector 60 is required to be as large in the connecting direction B as at least the sum of sizes of the region of the hole 83 and the ground contact portion 65B. As a result, the electrical connector device 1 is not able to be downsized. Further, in case described above, the hole 83 and the ground contact portion 65B are close to each other. Therefore, the flux being scattered as the ground contact portion 65B is soldered is able to attach to the contact 70 disposed inside the receptacle connector 60 through the hole 83. As a result, it is possible to prevent the contacts from contacting electrically. Consequently, the region of the hole 83 and the ground contact portion 65B are not arranged to be situated on the same line in the direction substantially parallel with the connecting direction B.

In addition, even though the region of the hole 83 and the ground contact portion 65B are not arranged on the same line substantially parallel with the connecting direction B, when the region of the hole 83 and the ground contact portion 65B are arranged not to be situated at all on the same line substantially parallel with the longitudinal direction A (e.g., the dashed line b in FIG. 6) which is perpendicular to the connecting direction B, it is unable to downsize the electrical connector device 1 by reason which is described above as well.

Therefore, the region of the hole 83 and the ground contact portion 65B are necessary to be arranged so that at least portions thereof are situated on the same line substantially parallel with the longitudinal direction A which is perpendicular to the connecting direction B, while not being arranged on the same line substantially parallel with the connecting direction B.

Further, it is preferred that a plurality of the ground contact pieces 80 is provided along the longitudinal direction A of the receptacle connector 60, as well as the ground contact portion 65B. As a result, the receptacle connector 60 is able to contact with the ground through the plug connector 10 and the board more certainly.

Further, it is preferred that the ground contact piece 80 and the ground contact portion 65B are arranged alternately by a specified distance in the longitudinal direction A. Consequently, it is possible to solve a problem about the flux scattered as described above since the holes 83 are arranged so as to have a distance far enough from next to each other by providing the ground contact portion 65B between the holes 83. In addition, when the plug connector 10 and the receptacle connector 60 are connected to each other, it is possible to equally disperse a force the receptacle connector 60 receives from the plug connector 10 in the longitudinal direction A of the receptacle connector 60.

In the embodiment, the plug connector 10 is configured as the connector for the cable, being capable of attaching the cable 20 thereto. Not limited to the case described above, the present invention is clearly applied to a case that the cable is not provided, or in a case that the receptacle connector 60 is capable of attaching the cable thereto.

As described above, the present invention is applicable to an electrical connector device including a pair of connectors being capable of connecting to each other, in particular, an electrical connector device including one connector with a ground contact portion mounted on a board, a ground contact piece arranged therein for contacting a fitting portion of another connector.

The disclosure of Japanese Patent Application No. 2011-176088 filed on Aug. 11, 2011, is incorporated in the application by reference.

While the invention has been explained with reference to the specific embodiments of the invention, the explanation is illustrative and the invention is limited only by the appended claims.

What is claimed is:

1. An electrical connector device, comprising:

a first connector including a first metal shell member; and a second connector to be mounted on a board and including a second metal shell member, said second connector including an opening portion for receiving a fitting portion of the first connector in a fitting direction;

wherein said second metal shell member includes a ground connecting portion to be contacted with the board and a ground contacting member situated in a cut hole, said ground contacting member is arranged at each of a plurality of positions along an arrangement direction perpendicular to the fitting direction, said ground connecting portion is arranged at least partially on a first imaginary straight line that is on the second metal shell member and perpendicular to the arrangement direction and a second imaginary straight line that is on the second metal shell member and in parallel to the arrangement direction, said cut hole is not situated on the first imaginary straight line and is situated at least partially on the second imaginary straight line, said cut hole is situated away from an edge of the second shell member as a discrete hole a distal end of the ground contacting member faces an edge of the cut hole.

2. The electrical connector device according to claim 1, wherein said ground connecting portion is formed of a part of the second metal shell member being bent toward the board.

3. The electrical connector device according to claim 1, wherein said ground connecting portion is formed of a part of the second metal shell member being punched in a protruded shape toward the board.

4. The electrical connector device according to claim 1, wherein said ground connecting portion is arranged at each of a plurality of positions along the first imaginary straight line, and said ground contacting member is arranged at each of a plurality of positions along the first imaginary straight line.

5. The electrical connector device according to claim 1, wherein said ground connecting portion and said ground contacting member are arranged alternately with a specific distance in between.

6. The electrical connector device according to claim 1, wherein said ground contacting member is formed in a cantilever-shape along the fitting direction.

7. The electrical connector device according to claim 1, wherein said ground contacting member is supported on a side of the opening portion, said ground contacting member including a free end portion on a side opposite to the opening portion.

8. An electrical connector to be mounted on a board, comprising:

a metal shell member; and an opening portion for receiving a fitting portion of a mating connector in a fitting direction;

wherein said metal shell member includes a ground connecting portion to be contacted with the board and a ground contacting member situated in a cut hole, said ground contacting member is arranged at each of a plurality of positions along an arrangement direction perpendicular to the fitting direction, said ground connecting portion is arranged at least partially on a first imaginary straight line that is on the metal shell member and perpendicular to the arrangement direction and a second imaginary straight line that is on the metal shell member and in parallel to the arrangement direction, said cut hole is not situated on the first imaginary straight line and is situated at least partially on the second imaginary straight line, said cut hole is situated away from an edge of the shell member as a discrete hole a distal end of the ground contacting member faces an edge of the cut hole.

* * * * *